US010876414B2

(12) United States Patent
Ahmad et al.

(10) Patent No.: US 10,876,414 B2
(45) Date of Patent: Dec. 29, 2020

(54) GUIDE VANE HAVING A CONNECTING TUBE

(71) Applicant: Siemens Aktiengesellschaft, Munich (DE)

(72) Inventors: Fathi Ahmad, Kaarst (DE); Radan Radulovic, Bochum (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 80 days.

(21) Appl. No.: 16/089,645

(22) PCT Filed: Apr. 11, 2017

(86) PCT No.: PCT/EP2017/058628
§ 371 (c)(1),
(2) Date: Sep. 28, 2018

(87) PCT Pub. No.: WO2017/182322
PCT Pub. Date: Oct. 26, 2017

(65) Prior Publication Data

US 2019/0120068 A1 Apr. 25, 2019

(30) Foreign Application Priority Data

Apr. 21, 2016 (EP) ..... 16166430

(51) Int. Cl.
*F01D 5/18* (2006.01)
*F01D 9/06* (2006.01)

(52) U.S. Cl.
CPC ..... *F01D 5/188* (2013.01); *F01D 9/065* (2013.01); *F05D 2230/232* (2013.01); *F05D 2230/237* (2013.01)

(58) Field of Classification Search
CPC ..... F01D 5/188; F01D 5/189; F01D 9/065
See application file for complete search history.

(56) References Cited

U.S. PATENT DOCUMENTS 3,301,527 A 1/1967 Kercher
4,288,201 A * 9/1981 Wilson ..... F01D 5/189 415/115

(Continued)

FOREIGN PATENT DOCUMENTS

DE 69917524 T2 6/2005
EP 2840231 A1 * 2/2015

(Continued)

OTHER PUBLICATIONS

International Search Report dated Jun. 19, 2017, for corresponding PCT/EP2017/058628.

(Continued)

*Primary Examiner* — Brian P Wolcott

(57) ABSTRACT

A guide vane for a turbomachine having an outer platform, a blade airfoil protruding from the outer platform, extending in a longitudinal direction and defining a cavity in its interior, an inner platform arranged opposite the outer platform and connected to the blade airfoil, and a connecting tube which passes through the cavity of the blade airfoil in the longitudinal direction. The first free end of the tube is inserted into a through-opening formed in the inner platform and materially bonded to the inner platform, and the second free end of the tube is arranged in a cooling fluid inlet opening formed on the outer platform, away from the edge thereof, and projecting outward from the outer platform. At least one guide is attached to the outer platform and designed to guide the connecting tube in the longitudinal direction in the event of a thermal change in length.

16 Claims, 6 Drawing Sheets

(56) References Cited

U.S. PATENT DOCUMENTS

| | | | | |
|---|---|---|---|---|
| 6,163,959 | A * | 12/2000 | Arraitz | F01D 9/065 29/889.1 |
| 9,581,028 | B1 * | 2/2017 | Jones | F01D 5/18 |
| 9,617,870 | B2 * | 4/2017 | Chokshi | F01D 9/065 |
| 9,920,869 | B2 * | 3/2018 | Davis | F16L 37/086 |
| 10,174,619 | B2 * | 1/2019 | Uskert | F01D 5/147 |
| 2004/0062637 | A1 | 4/2004 | Dube et al. | |
| 2004/0208748 | A1 | 10/2004 | Schwartz et al. | |
| 2015/0125291 | A1 | 5/2015 | Chokshi | |

FOREIGN PATENT DOCUMENTS

| | | | |
|---|---|---|---|
| EP | 2840231 | A1 | 2/2015 |
| GB | 2058944 | A | 4/1981 |
| JP | S56047605 | | 4/1981 |
| JP | 2004028036 | A | 1/2004 |
| JP | 2004251280 | A | 9/2004 |
| JP | 2012246785 | A | 12/2012 |

OTHER PUBLICATIONS

EP search report dated Oct. 21, 2016, for corresponding EP patent application No. 16166430.5.

* cited by examiner

GUIDE VANE HAVING A CONNECTING TUBE

CROSS REFERENCE TO RELATED APPLICATIONS

This application is the US National Stage of International Application No. PCT/EP2017/058628 filed Apr. 11, 2017, and claims the benefit thereof. The International Application claims the benefit of European Application No. EP16166430 filed Apr. 21, 2016. All of the applications are incorporated by reference herein in their entirety.

FIELD OF INVENTION

The invention relates to a guide vane for a turbomachine, in particular a gas turbine, having, in the properly mounted state, an outer platform, an airfoil which projects from the outer platform, extends in a longitudinal direction and defines a cavity in its interior, an inner platform which is arranged opposite to the outer platform and is connected to the airfoil, and a connecting tube which passes through the cavity of the airfoil in the longitudinal direction, the first free end of which tube is inserted into a through-opening formed in the inner platform and connected to the inner platform in an integrally formed manner, and the second free end of which tube is arranged in a cooling fluid inlet opening formed on the outer platform, at a distance from the edge of said opening, and projects outward from the outer platform.

BACKGROUND OF INVENTION

Turbomachines such as gas turbines, for example, are known in the prior art in various designs and serve to convert thermal energy and flow energy of a working fluid, in particular a hot gas, into rotational energy. They comprise a housing in which a flow duct extends in an axial direction. A plurality of turbine stages are arranged behind one another and at a distance from one another in the axial direction in the flow duct.

Each turbine stage comprises a plurality of guide vanes which form a guide vane ring connected to the housing and in order to favorably influence the flow direction of the working fluid. Such a guide vane customarily comprises a platform which is arranged radially to the outside in the properly mounted state of the guide vane. Furthermore, the guide vane comprises an airfoil which projects from the outer platform and extends in a longitudinal direction. In addition, the guide vane has an inner platform which is connected to the airfoil opposite to the outer platform. The guide vane ring is closed off to the inside by a retaining ring in which the inner platforms of the guide vanes are retained.

Moreover, each turbine stage comprises a plurality of guide vanes which form a guide vane ring which is connected to a centrally mounted rotor which passes through the housing in the axial direction. Furthermore, circumferential grooves in which the retaining rings of the guide vane rings are arranged are formed in the rotor.

During the operation of the turbomachine, a working fluid flows through the flow duct of the turbomachine. The working fluid flowing through the flow duct is deflected by the guide vanes in such a way that it optimally impinges the guide vanes arranged behind and applies a force thereto. The torque imparted by the guide vanes sets the rotor in rotation. The rotational energy of the rotor can be converted into electrical energy by means of a generator, for example.

The thermodynamic efficiency of gas turbines is higher the higher the inlet temperature of the hot gas into the gas turbine. However, limits are set on the magnitude of the inlet temperature, inter alia by the thermal loadability of the components arranged in the flow duct. Accordingly, an objective consists in providing components which have a mechanical resistance sufficient for the operation of the gas turbine even under very high temperatures of the hot gas.

A possibility of increasing the thermal loadability of a guide vane, for example, consists in conducting heat away from the guide vane by means of a cooling fluid. For this purpose, a cavity through which the cooling fluid flows is provided in its interior.

The retaining rings on the inner sides of the guide vane rings are also greatly heated by the hot gas flowing into the circumferential groove. A tried and tested means for cooling a retaining ring is to design the retaining ring with a U-shaped cross section, with the result that a run-around cooling fluid groove is created in the retaining ring. This cooling fluid groove is supplied with cooling fluid which flows from the guide vanes through an outlet opening provided in the inner platform into the cooling fluid groove of the retaining ring. However, this cooling fluid has already received heat in the airfoil of the guide vane, which reduces the cooling power available for the retaining ring.

A higher cooling power of the cooling fluid in the retaining ring can be achieved by a specific connecting tube (jumper tube) which passes through the cavity of the airfoil of the guide vane in the longitudinal direction and through which the cooling fluid flows directly and largely unheated into the cooling fluid groove of the retaining ring.

A first free end of the connecting tube is inserted into a through-opening formed in the inner platform and connected to the inner platform in an integrally bonded manner. The second free end of the connecting tube is arranged in a cooling fluid inlet opening formed on the outer platform, at a distance from the edge of said opening, and projects outward from the outer platform.

For positioning purposes, connecting tubes can have positioning means in their second free end region which extend in opposite directions starting from the connecting tube and are supported on the pressure-side and the suction-side edge of the cooling fluid inlet opening. However, it has been shown that these positioning means can be inadequate in order to ensure a sufficiently reliable positioning of the connecting tube in the cooling fluid inlet opening with regard to strong operationally induced vibrations of the turbomachine and thermal changes in length of the connecting tube.

SUMMARY OF INVENTION

Taking this prior art as a starting point, it is an object of the present invention to provide a guide vane of the type stated at the outset which allows a simple and reliable positioning of the connecting tube in the cooling fluid inlet opening in a cost-effective manner.

This object is achieved according to the invention by a guide vane of the type stated at the outset in which at least one guide means is fastened to the outer platform for guiding the connecting tube and is designed and arranged in such a way that, with the formation of a sliding fit, it guides the connecting tube in the longitudinal direction in the event of a thermal change in length.

The invention is based on the consideration of providing guide means for guiding the connecting tube on the outer platform which allow a movement of the connecting tube resulting from a thermal change in length without risking the positioning thereof in the cooling fluid inlet opening. In other words, as a departure from the positioning means provided on the connecting tube, the guide means provided on the outer platform can limit the degrees of freedom of movement of the connecting tube to the longitudinal direction of the guide vane.

The at least one guide means advantageously extends in the direction of the connecting tube starting from the outer platform and at least partially, in particular completely, surrounds a portion of the connecting tube while allowing a play. Such a guide means holds the connecting tube relative to the outer platform, in particular in terms of the distance from the edge of the cooling fluid inlet opening, in a predetermined position. Given that the connecting tube is at least partially laterally surrounded, with said tube being allowed a play, the connecting tube retains the freedom to move in the longitudinal direction into where it is surrounded in the event of a thermal change in length.

According to one embodiment, the at least one guide means has a guide opening. This guide opening is traversed by the connecting tube or a portion of the connecting tube, with the result that the connecting tube is held securely transversely with respect to the longitudinal direction.

According to a variant of the guide vane according to the invention, at least one guide projection which extends in the longitudinal direction is formed on the second free end of the connecting tube corresponding to the guide opening of the at least one guide means and engages through the guide opening of the at least one guide means. In this way, the guide opening can have a smaller cross-sectional area than the connecting tube, with the result that the dimensions of the guide means can also be reduced. The smaller the dimensions of the guide means, the less is the cooling fluid impeded from entering the cooling fluid inlet opening.

The at least one guide projection is advantageously designed in the manner of a pin. Here, the cross section of the guide projection perpendicular to the longitudinal direction can be designed to be round, square or rectangular, for example.

In particular, two guide means are provided which extend in the direction of the connecting tube starting from opposite regions of the outer platform and in particular point toward one another. Two guide means arranged in such a way make it possible to counteract a rotational movement of the connecting tube about its longitudinal axis, which further improves the positioning effect of the guide means.

According to a further development, the two guide means take the form of metal sheets which are connected to the outer platform in an integrally bonded manner, in particular by welding or brazing. Metal sheets which are attached by welding or brazing constitute guide means which can be produced in a particularly cost-effective and simple manner.

Correspondingly, two guide projections can be arranged opposite one another and at a distance from one another on the connecting tube and surrounded by a respective guide means.

The distance between the two guide projections advantageously lies in the range from 5 mm and 10 mm and is advantageously 7 mm. Such distances correspond to the diameters of conventional connecting tubes.

In the case of a guide vane according to the invention, the two guide means can be provided on the pressure side and on the suction side of the connecting tube. This arrangement allows particularly short guide means, which is associated with an improved vibration behavior of the guide means.

The airfoil can have a peripheral wall in a manner known per se. Here, the connecting tube is arranged in the cavity at a distance from the peripheral wall. In this way, a heat bridge between the connecting tube and the hot peripheral wall of the airfoil is avoided and the cooling fluid flowing around the connecting tube additionally ensures thermal insulation.

In a manner known per se, the integrally bonded connection between the connecting tube and the inner platform can be produced by welding or brazing.

The connection between the connecting tube and the inner platform is advantageously fluid-tight. This prevents a situation in which heated cooling fluid can escape from the cavity into the retaining ring of the guide vane ring.

BRIEF DESCRIPTION OF THE DRAWINGS

Further features and advantages of the present invention will become clear on the basis of a guide vane according to an embodiment of the present invention with reference to the appended drawing, in which.

DETAILED DESCRIPTION OF INVENTION

Figure 1:
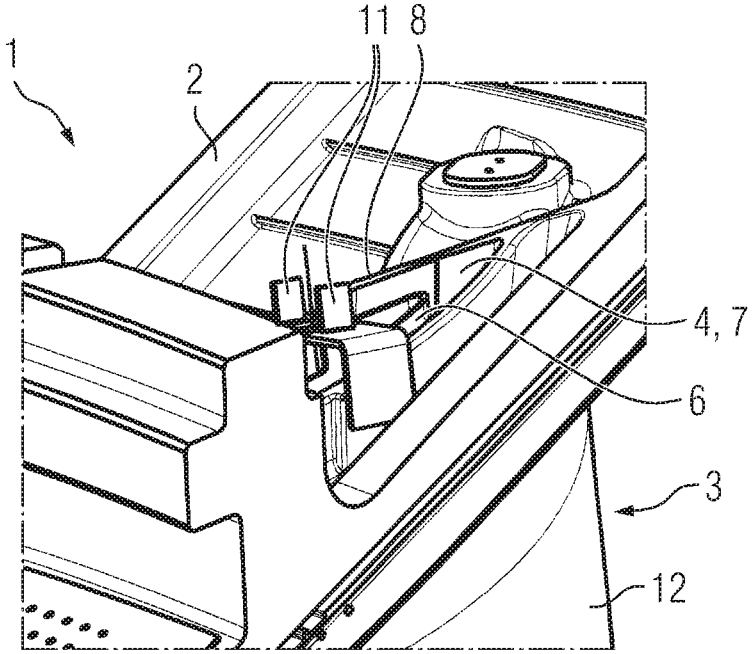
FIG. 1 shows a partial perspective view of a guide vane according to an embodiment of the present invention.
Figure 2:
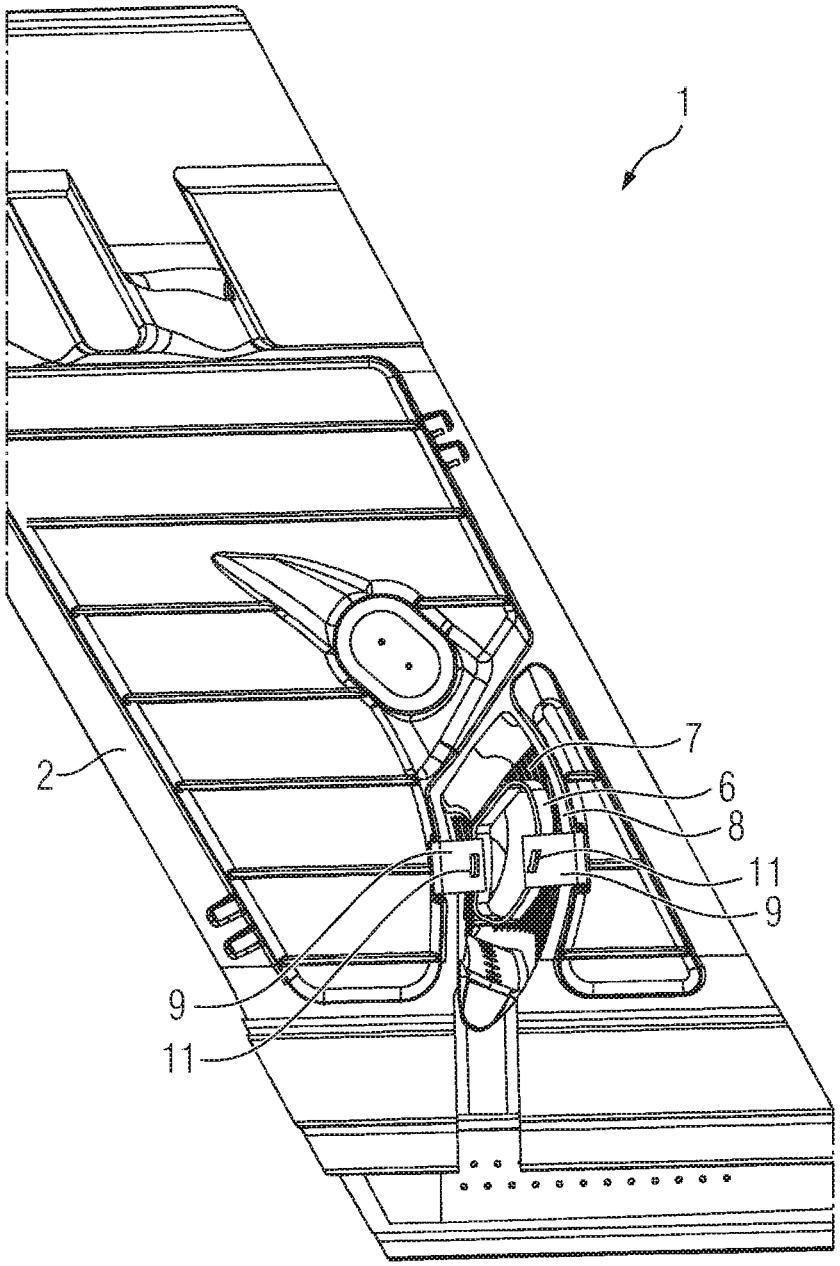
FIG. 2 shows a plan view of the guide vane illustrated in FIG. 1 from outside.
Figure 3:
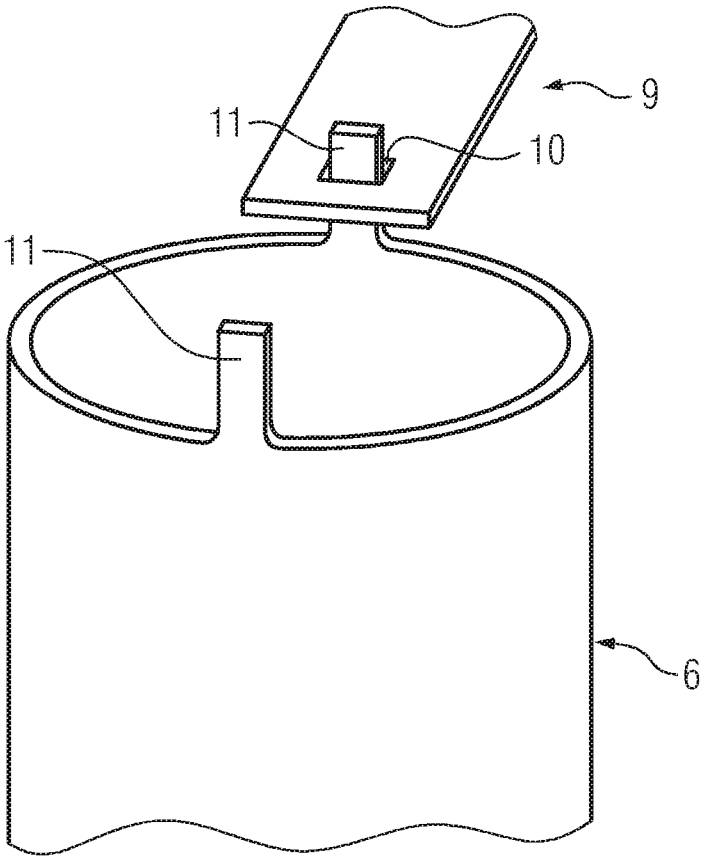
FIG. 3 shows a partial perspective view of a connecting tube of the guide vane illustrated in FIG. 1.

FIGS. 1 to 3 show a guide vane 1 for a turbomachine (not shown), in particular a gas turbine, according to an embodiment of the present invention. The guide vane 1 has an outer platform 2 which, in the properly mounted state of the guide vane 1, is arranged radially to the outside. Furthermore, the guide vane 1 comprises an airfoil 3 which extends in a longitudinal direction L and projects from the outer platform 2. A cavity 4 is defined in the interior of the airfoil 3. In addition, the guide vane 1 has an inner platform 5 which is arranged opposite to the outer platform 2 and is connected to the airfoil 3.

Moreover, the guide vane 1 comprises a connecting tube 6 which passes through the cavity 4 of the airfoil 3 in the longitudinal direction L. A first free end of the connecting tube 6 is connected to the inner platform 5 in an integrally bonded manner by welding and so as to be fluid-tight. The second free end of the connecting tube 6 is arranged in a cooling fluid inlet opening 7 formed on the outer platform 2, at a distance from the edge 8 of said opening, and projects outward from the outer platform 2.

To guide the connecting tube 6, two guide means 9 are fastened to the outer platform 2 which extend in the direction of the connecting tube 6 starting from opposite regions of the outer platform 2 and point toward one another. The guide means 9 take the form of metal sheets which are arranged on the pressure side and the suction side of the airfoil 3 and connected to the outer platform 2 in an integrally bonded manner by welding.

Each guide means 9 has a slot-shaped guide opening 10 in order to completely surround a portion 11 of the connecting tube 6 while allowing a play. Alternatively, a partial surround can also suffice.

In the present case, the two portions 11 are provided as guide projections 11 which extend in the longitudinal direction L, are formed on the second free end of the connecting tube 6 corresponding to the guide openings 10 and pass through the guide openings 10 of the two guide means 9. Thus, a sliding fit which may be subject to play is realized, with the result that the two guide projections 11 are displaceably guided in the guide means. The guide projections 11 are designed in the manner of pins with a rectangular cross section and arranged opposite one another and at a distance from one another on the connecting tube 6. The distance between the two guide projections 11 is approximately 7 mm.

The airfoil 3 has a peripheral wall 12, the connecting tube 6 being arranged at a distance therefrom in the cavity 4.

Figure 4:
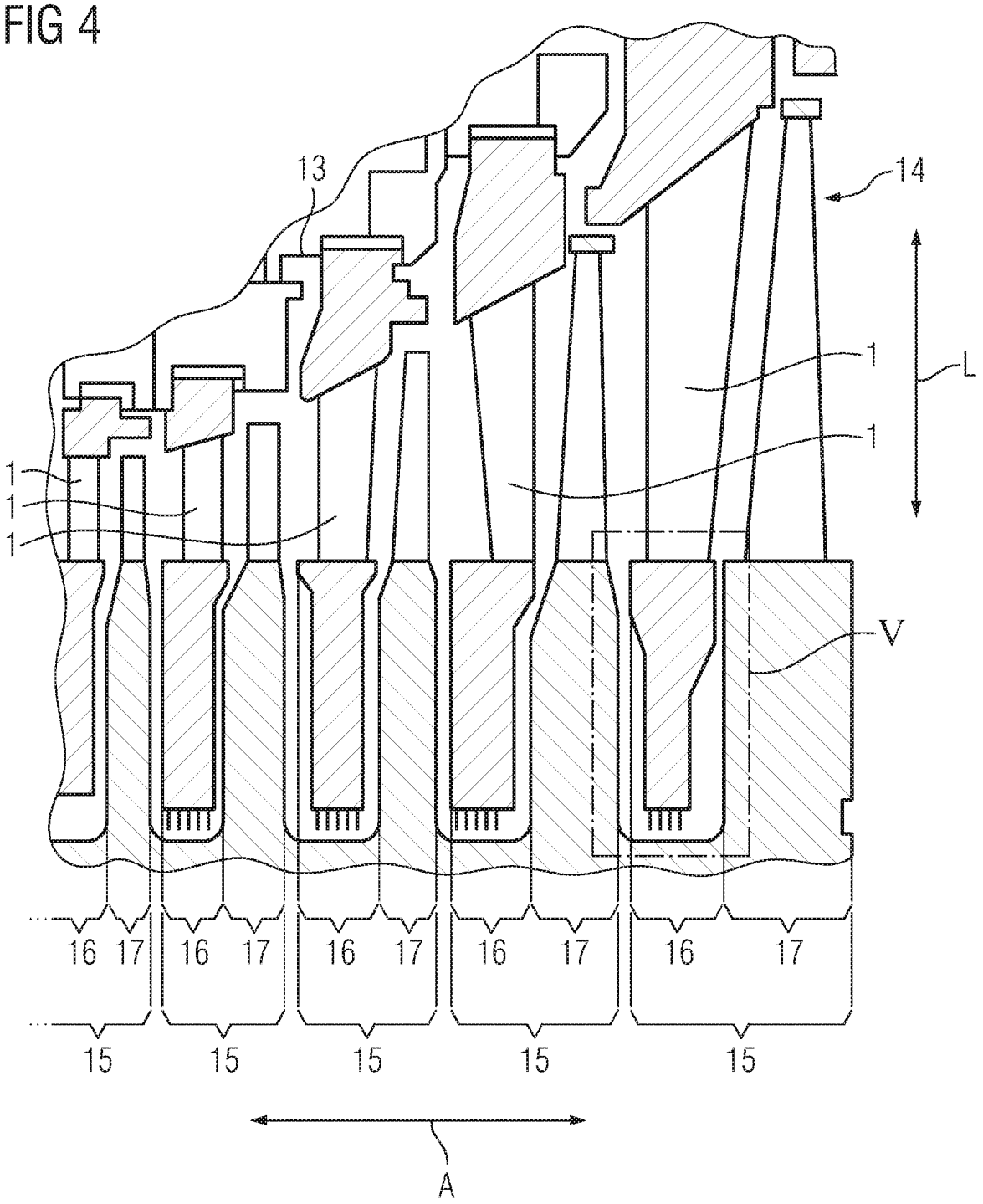
FIG. 4 shows a partial cross-sectional view of a turbomachine having guide vanes according to the embodiment illustrated in FIG. 1.
Figure 5:
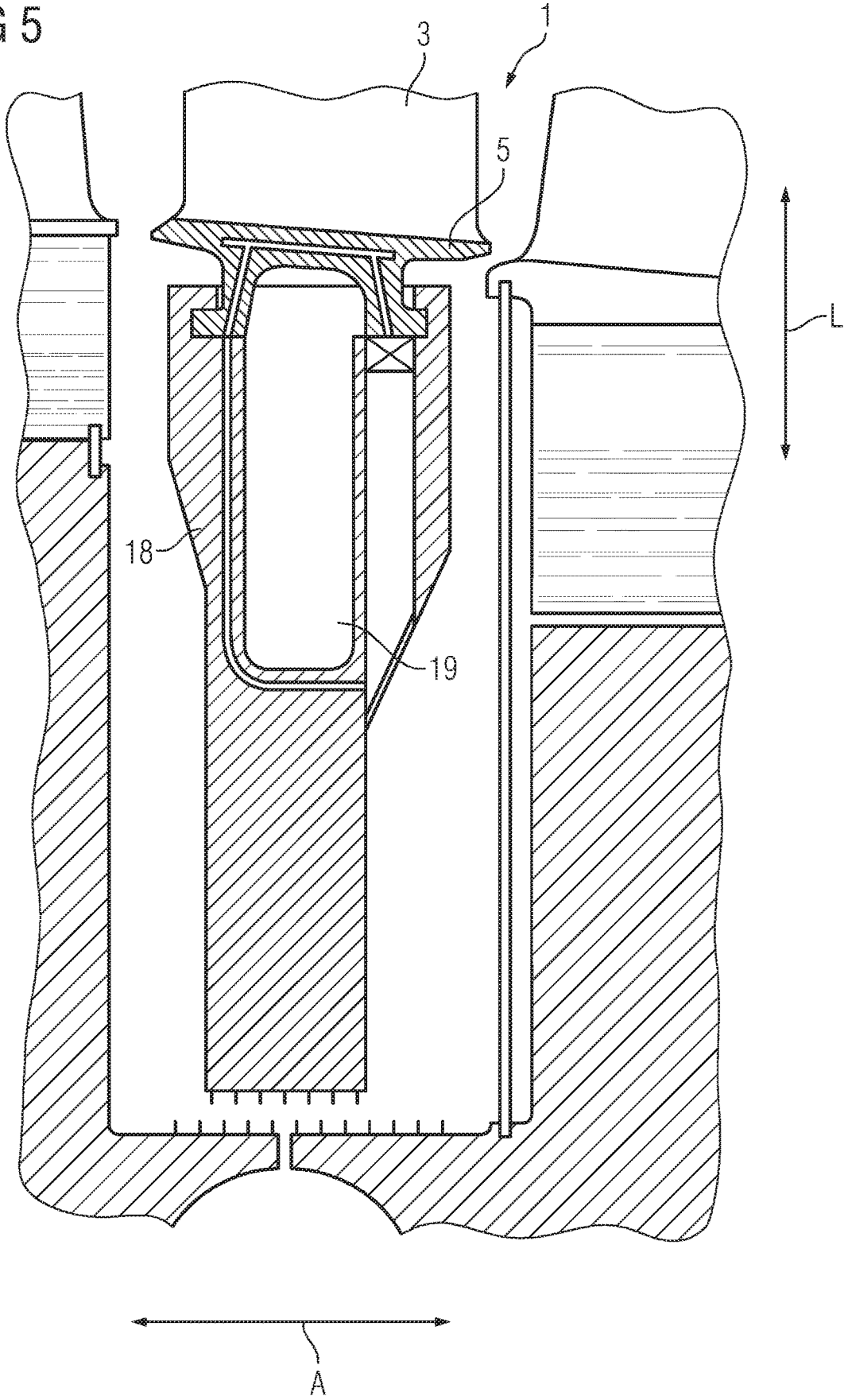
FIG. 5 shows an enlarged detail view of the excerpt designated in FIG. 4 by the reference sign V.

FIGS. 4 and 5 schematically show a portion of a turbomachine having guide vanes 1 according to the invention. The turbomachine comprises a housing 13 in which a flow duct 14 extends in an axial direction A. Furthermore, the turbomachine comprises a plurality of turbine stages 15 which each comprise a guide vane ring 16 and a guide vane ring 17, the turbine stages 15 being arranged behind one another and at a distance from one another in the axial direction A in the flow duct 14. The guide vane rings 16 are each formed from a plurality of guide vanes 1 according to the invention and each comprise a U shaped retaining ring 18 with a run-around cooling fluid groove 19 in which the inner platforms 5 of the guide vanes 1 are retained.

Figure 6:
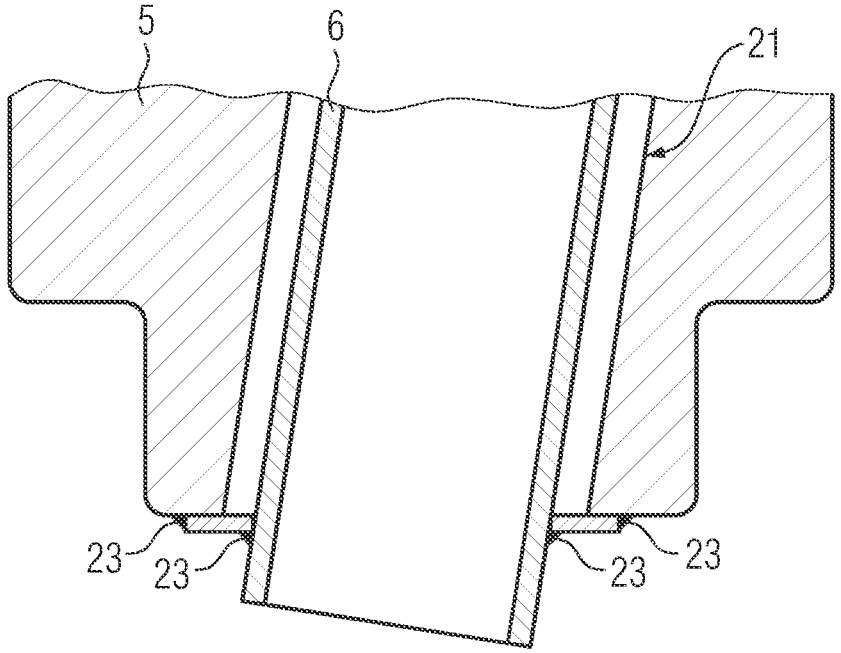
FIG. 6 shows a cross section of a first free end of the connecting tube inserted into a through-opening in the inner platform and connected to the platform in an integrally formed manner.

FIG. 6 shows a cross section of a first free end of the connecting tube 6 inserted into a through-opening 21 in the inner platform 5 and connected to the inner platform 5 in an integrally formed manner via a weld 23.

During the operation of the turbomachine, an expanding hot gas flows through the flow duct 14. In order to reduce the thermal loading of the guide vane rings 16, a cooling fluid simultaneously flows through and cools the guide vanes 1 of the guide vane rings 16. To cool the airfoil 3, one part of the cooling fluid flows through the cooling fluid inlet opening 7 in the cavity 4, while, to cool the retaining ring 18, another part of the cooling fluid flows through the connecting tube 6 directly into the retaining ring 18 and without heating contact with the peripheral wall 12 of the airfoil 3.

An advantage of the guide vane 1 according to the invention lies in the fact that, in the event of a thermally induced change of length, the connecting tube 6 can move in the guide openings 10 of the guide means 9 in the longitudinal direction L without leaving its position in the cooling fluid inlet opening 7 relative to the edge 8 thereof. Freedoms of movement of the connecting tube 6 relative to the outer platform 2 which go beyond this are avoided by the guide means 9 fastened to the outer platform 2.

Although the invention has been illustrated and described more closely in detail by the preferred exemplary embodiment, the invention is not limited by the disclosed examples and other variations can be derived therefrom by a person skilled in the art without departing from the scope of protection of the invention.

The invention claimed is:

1. A guide vane for a turbomachine, comprising:

an outer platform, an airfoil which projects from the outer platform, extends in a longitudinal direction and defines a cavity in its interior, an inner platform which is arranged opposite to the outer platform and is connected to the airfoil, and a connecting tube which passes through the cavity of the airfoil in the longitudinal direction, a first free end of which tube is inserted into a through-opening formed in the inner platform and connected to the inner platform in an integrally formed manner, and a second free end of which tube is arranged through a cooling fluid inlet opening formed on the outer platform, at a distance from an edge of said opening, and projects outward from the outer platform, at least one guide which is fastened to the outer platform for guiding the connecting tube and is designed and arranged in such a way that, with the formation of a sliding fit, the at least one guide guides the connecting tube in the longitudinal direction in the event of a thermal change in length, wherein the at least one guide comprises a guide opening, and wherein at least one guide projection which extends in the longitudinal direction is formed on the second free end of the connecting tube corresponding to the guide opening of the at least one guide and engages through the guide opening of the at least one guide.

2. The guide vane as claimed in claim 1, wherein the at least one guide extends in a direction of the connecting tube starting from the outer platform and at least partially surrounds a portion of the connecting tube while allowing a play.

3. The guide vane as claimed in claim 1, wherein the at least one guide projection is designed in the manner of a pin.

4. The guide vane as claimed in claim 1, wherein the at least one guide comprises two guides which extend in a direction of the connecting tube starting from opposite regions of the outer platform.

5. The guide vane as claimed in claim 4, wherein the two guides take the form of metal sheets which are connected to the outer platform in an integrally bonded manner, or by welding or brazing.

6. The guide vane as claimed in claim 4, wherein the at least one guide projection comprises two guide projections arranged opposite one another and at a distance from one another on the connecting tube and each guide projection of the two guide projections is surrounded by one guide of the two guides.

7. The guide vane as claimed in claim 6, wherein the distance between the two guide projections is in the range from 5 mm and 10 mm.

8. The guide vane as claimed in claim 6, wherein the two guides are provided on a pressure side and on a suction side of the connecting tube.

9. The guide vane as claimed in claim 1, wherein the airfoil comprises a peripheral wall.

10. The guide vane as claimed in claim 9, wherein the connecting tube is arranged in the cavity at a distance from the peripheral wall.

11. The guide vane as claimed in claim 1, wherein the integrally bonded connection between the connecting tube and the inner platform is produced by welding or brazing.

12. The guide vane as claimed in claim 1, wherein the connection between the connecting tube and the inner platform is fluid-tight.

13. The guide vane as claimed in claim 1,
wherein the turbomachine is a gas turbine and the inner platform and the outer platform are in a properly mounted state.

14. The guide vane as claimed in claim 2,
wherein the at least one guide extends in the direction of the connecting tube starting from the outer platform and completely surrounds the portion of the connecting tube while allowing the play.

15. The guide vane as claimed in claim 4,
wherein the two guides point toward one another.

16. The guide vane as claimed in claim 7,
wherein the distance between the two guide projections is 7 mm.

* * * * *